United States Patent [19]

Habig

[11] 3,971,549

[45] July 27, 1976

[54] PROCESS AND APPARATUS FOR TREATING AND TRANSFERRING METAL IN THE LIQUID STATE

[76] Inventor: Alan L. Habig, 4048 Lehigh Blvd., Decatur, Ga. 30034

[22] Filed: Mar. 5, 1975

[21] Appl. No.: 555,438

[52] U.S. Cl. ..... 266/215; 137/209; 137/571; 164/254; 164/266; 266/239

[51] Int. Cl.[2] ..... C21B 13/14

[58] Field of Search ..... 266/34 R, 34 V, 38, 266/215, 236, 239; 137/571, 209; 417/118, 121; 164/65, 254, 266, 270; 222/DIG. 15, 56; 259/18, 60

[56] References Cited

UNITED STATES PATENTS

| | | | |
|---|---|---|---|
| 2,882,570 | 4/1959 | Brennan | 266/34 V |
| 3,116,998 | 1/1964 | Pagonis | 266/34 V |
| 3,356,490 | 12/1967 | Muller et al. | 266/35 X |
| 3,443,577 | 5/1969 | Nilsson | 137/571 X |

*Primary Examiner*—Roy Lake
*Assistant Examiner*—Paul A. Bell
*Attorney, Agent, or Firm*—Byron O. Dimmick

[57] ABSTRACT

Metal in the molten state is transferred from one treating stage or zone to a succeeding stage or zone by gravity flow, the flow from one zone to the next being controlled by gas pressure, thus eliminating the need for valves, gates or similar moving parts. The process is particularly adapted to the treating of ferrous metal, more particularly to the making of steel. By providing sufficient zones in the series a continuous process can be run, starting with feed from a blast furnace, and conducting the material through alloying stages and a degassing stage and into a continuous casting zone.

7 Claims, 4 Drawing Figures

PROCESS AND APPARATUS FOR TREATING AND TRANSFERRING METAL IN THE LIQUID STATE

REFERENCE TO THE PRIOR ART

In U.S. Pat. No. 3,123,015 of Samuel E. Linklater there is disclosed a pump for the transfer of molten metals and corrosive liquids wherein said pump has no valves or pistons or other moving parts. That pump includes a reservoir, a standpipe within the reservoir having an open upper end located below the normal level of liquid within the reservoir, a standpipe enclosure open at its lower end located below the upper end of the standpipe, the inside diameter of the enclosure being greater than the outside diameter of the standpipe, thereby providing an annulus for liquid communication between the reservoir and the opening of the standpipe, and means for introducing pressurized fluid into the standpipe enclosure above the normal liquid level within the enclosure. Introduction of pressurized fluid into the standpipe enclosure is used to cause liquid to leave the standpipe through withdrawal means.

The present invention also provides a reservoir, a standpipe, a standpipe enclosure and means for introducing gas under pressure into the standpipe enclosure. In this invention, however, a liquid trap is provided at the lower end of the standpipe, and the gas pressure is used as a valve to stop or control liquid flow rather than acting as a pump to induce liquid flow.

DESCRIPTION OF THE INVENTION

The present invention concerns a process and apparatus for handling and treating liquid metals. It is particularly adapted to the making of steel but it can be applied to the handling of other metals as well. The apparatus comprises at least two treating zones placed at different elevations from each other, with a transfer conduit or pipe connecting them, the open upper end of the pipe terminating below the normal level of liquid in the upper zone, and the open lower end of the pipe or conduit terminating above or below the normal level of liquid in the lower zone. The lower end of the pipe is provided with a dip leg or trap, which is an important feature of the invention, as will be understood from the ensuing description. Surrounding the upper inlet end of the transfer pipe or conduit is a larger pipe that extends below the inlet of the transfer pipe. Exertion of gas pressure within the larger pipe will cause the level of liquid in the annulus between the two pipes to be forced below the top of the inlet and thus prevent flow into the transfer pipe.

The nature of this invention will be more fully understood when reference is made to the drawings and the ensuing description.

Figure 1:
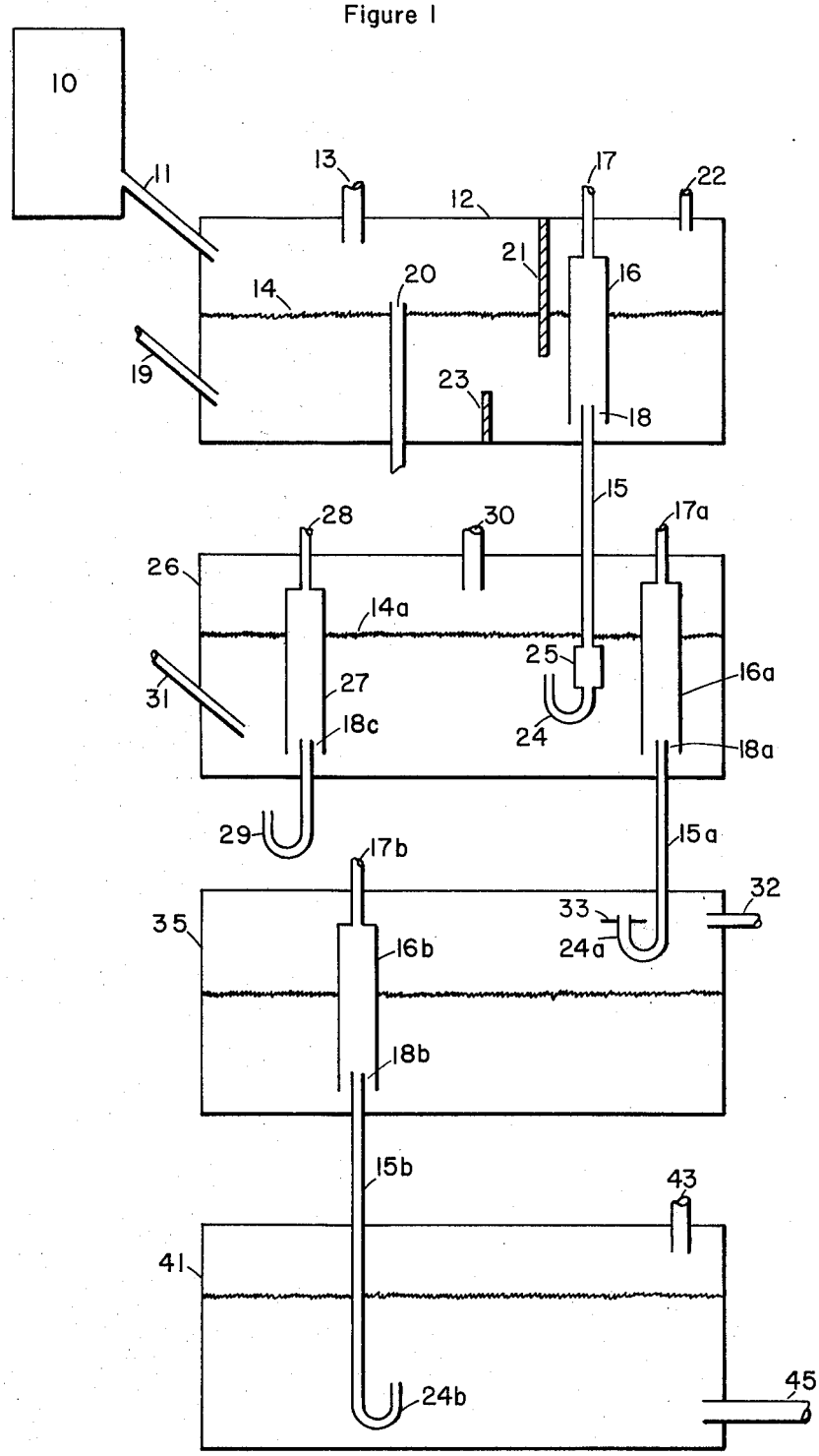
FIG. 1 is a schematic view showing four vertically spaced chambers or zones with transfer pipes or conduits arranged to transfer liquid from a particular zone to a zone below it, utilizing the flow control principle of the invention.

Referring now in detail to FIG. 1, there are shown a succession of four treating zones, zone or chamber 12 being a melt chamber and/or a primary alloy chamber into which molten metal can be introduced via pipe or conduit 11 from a blast furnace 10. Scrap metal and/or enriched iron ore can be introduced through inlet means 13 and melted by means of oxygen lance 19 or other conventional methods. Alloy metals and fluxes can also be added through inlet 13. Slag formed in this zone can be removed through outlet 20. Outlet 20, also referred to as a slag relief pipe, has its upper opening above the normal liquid level 14 of the molten metal. Wall 21 extends from the roof of chamber 12 to below the level of liquid metal in the chamber, thus effectively dividing the region above the liquid level into two separate gas pressure chambers. By increasing gas pressure on one side of the wall, i.e. by introducing gas through inlet 22, the level of the liquid on the other side of the wall will rise and allow the slag floating on the surface of the molten metal to flow out through outlet pipe 20.

Wall 21 and baffle 23 both serve to prevent floating and heavy slag from entering the region adjacent the intake of transfer pipe 15, referred to below, thereby preventing the major proportion of the slag from being transferred to a succeeding zone or chamber.

Positioned below the primary alloy chamber is a secondary alloy chamber 26. Connecting chamber 12 and chamber 26 is a transfer pipe or conduit 15. The open upper end of pipe 15 is below the normal liquid level 14 in the chamber 12, and the lower end of the transfer pipe 15 is bent upwardly so as to form a trap or dip leg 24. The opening at the lower end of transfer pipe 15 may be positioned below the normal liquid level 14a in chamber 25, although this is not necessary.

A gas pressure pipe 16, having a larger inside diameter than the outside diameter of transfer pipe 15, is positioned within chamber 12 so as to surround the upper inlet end of transfer pipe 15, the lower open end of gas pressure pipe 16 extending below the top of pipe 15 providing an annulus 18 between the two pipes. Gas pressure can be exerted within pressure pipe 16 by means of gas inlet 17. The gas should be inert, such as nitrogen, although argon is preferred.

One preferred feature of the invention is the provision of an enlarged section 25 at the lower end of transfer pipe 15. Section 25 has a larger inside diameter than the remaining portions of pipe 15 and thus serves to reduce the downward velocity and momentum of the liquid metal when flow is stopped, thereby enabling the exit end of the pipe 15 to be at a lower elevation in relation to dip leg 24 than would be otherwise necessary if no provision for reducing momentum were made. It is important to ensure that a quantity of liquid metal is maintained within the dip leg so that gas pressure is never allowed to escape into the next chamber and thereby upset control within that chamber.

Although only one transfer pipe 15 is shown with an enlarged section 25 in the drawing, in order to simplify the illustration, all of the transfer pipes can be provided with this feature as a means of momentum control. The enlarged section is preferably positioned so that it will extend from above to just below the horizontal level of the transfer pipe exit.

Treating in secondary alloy chamber 26 can be conducted on a batch type basis wherein a sample of the steel can be withdrawn through port 29 for analysis and then the required amounts of alloying materials may be added through port 30. Also oxygen can be introduced into the melt in chamber 25 via lance 31 to achieve the desired carbon content. The means for controlling the withdrawal of material through port 29 is preferably of the same nature as that employed for controlling flow between chambers, including a gas pressure pipe 27 and a gas inlet 28.

Arranged at a lower elevation than secondary alloy chamber 25 is a third zone or chamber 35, designated the degas chamber, since a vacuum can be applied in this chamber via vacuum line 32 to remove trapped gas from the molten metal. A transfer pipe 15*a* extending from below the normal liquid level in chamber 25 and terminating at its lower end in a dip leg or trap 24*a* serves to conduct molten metal from chamber 25 to degas chamber 35. The lower discharge end of pipe 15*a* can be above the normal liquid level in chamber 35, and is preferably provided with a circular, square or oblong splash plate 33 adjacent the discharge opening to provide a maximum liquid surface area to the vacuum. A gas pressure pipe 16*a* surrounds the upper end of transfer pipe 15*a* in the same manner as does gas pressure pipe 16 in primary chamber 12, and is provided with gas pressure inlet 17*a*.

A fourth chamber 41, serves as a casting chamber. Here metal will be mixed with that of previous batches, and continuous casting can be achieved by conventional methods, the metal flowing into the casting equipment through outlet 45. Transfer pipe 15*b* extending from below the normal liquid level in degas chamber 35 and terminating at its lower end in a dip leg or trap 24*b* serves to conduct molten metal from degas chamber 35 into casting chamber 41. A gas pressure pipe 16*b* is arranged with respect to transfer pipe 15*b* in the same manner as gas pressure pipe 16 is to transfer pipe 15. To prevent contamination and slag formation an atmosphere of inert gas can be maintained above the liquid level in casting chamber 41 at a desired pressure by means of gas connection 43.

Apparatus utilizing this invention will comprise a minimum of two vertically spaced stages connected by a transfer pipe 15 and having associated therewith a gas pressure pipe 16. With particular reference to FIG. 1, the blast furnace 10 could be omitted, and primary chamber 12 could be a basic oxygen furnace, an electric arc furnace, an induction furnace, etc. Also, in some arrangements one might require only the primary chamber and the casting chamber, with the two chambers connected by means of the transfer pipe 15 and the gas pressure pipe 16.

Although for the purpose of illustrating the invention the respective chambers are shown in substantially vertical alignment in FIG. 1, in actual practice they would be both horizontally and vertically spaced. Also, in such a construction the transfer pipes would preferably be supported by interior and exterior walls of the chambers with the dip leg traps accessible from the outside of the chambers to permit their being drained readily, as for example when the process is being shut down.

Although the transfer pipes and their associated gas pressure pipes are shown in FIG. 1 as concentrically disposed, a preferred construction that provides more rigid support would entail fastening a portion of the upper wall of the transfer pipe to the lower inner wall of the gas pressure pipe.

The various pipes and traps will be constructed of suitable refractory material to meet the requirements dictated by the temperatures involved and the metals being produced. One example of a usable material is a castable refractory blend of about 90 wt. % alumina and 10 wt. % silica having a maximum working temperature of about 3200°F., this being available as a trademarked material known as Cerox 720.

Figure 3:
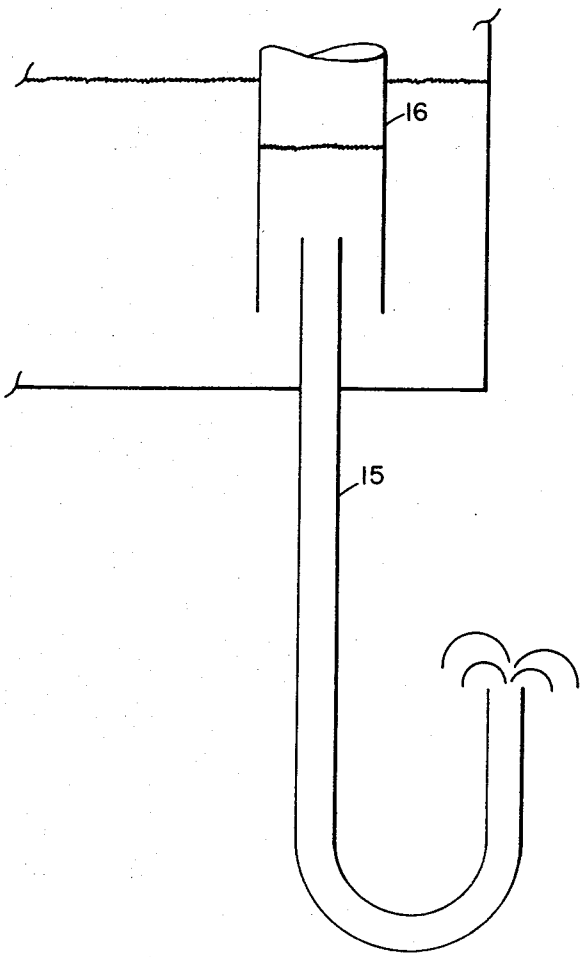
FIGS. 2 and 3 are schematic fragmentary elevational views showing, respectively, the liquid level condition when flow is cut off and when flow is occurring.
Figure 2:
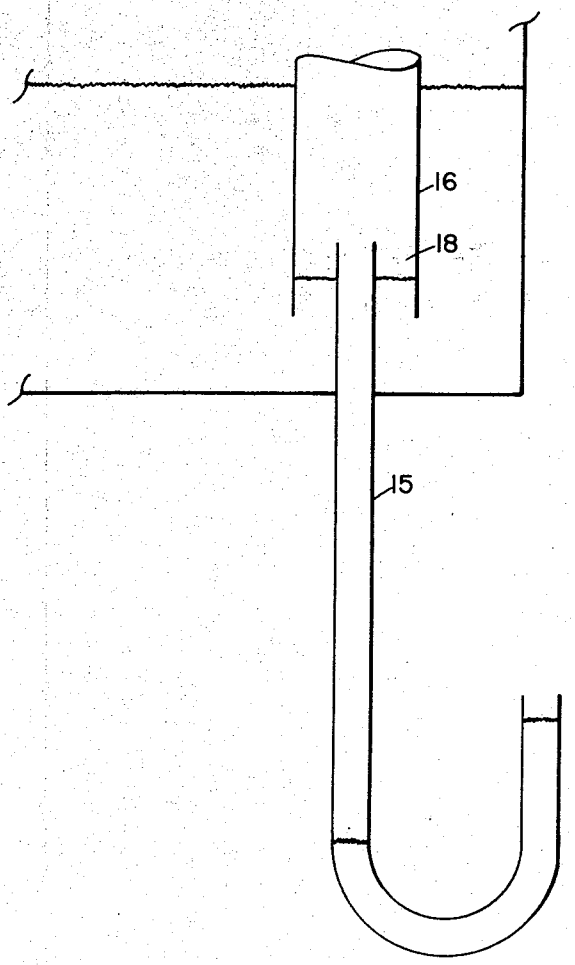

The principle on which the present invention operates to control the flow of molten metal from one zone or chamber to a succeeding one is evident from FIGS. 2 and 3. As shown in FIG. 2, with a sufficiently high pressure of gas in fluid pressure pipe 16 the liquid level in the annulus 18 will be kept below the top inlet of transfer pipe 15 and no flow into the inlet will occur. As shown in FIG. 3, if the gas pressure in pressure pipe 16 is lowered, the liquid level in the annulus will rise to the level of the inlet of pipe 15 and flow will begin. The function of the trap or dip leg at the lower end of transfer pipe 15 is to contain a sufficient head of molten metal to counterbalance the gas pressure within the gas pressure pipe.

For efficient control of the system it is preferred that the diameter of pressure pipe 16 be sufficiently greater than that of transfer pipe 15 so that the cross sectional area in the annulus 18 is greater than the cross sectional area inside pipe 15.

Figure 4:
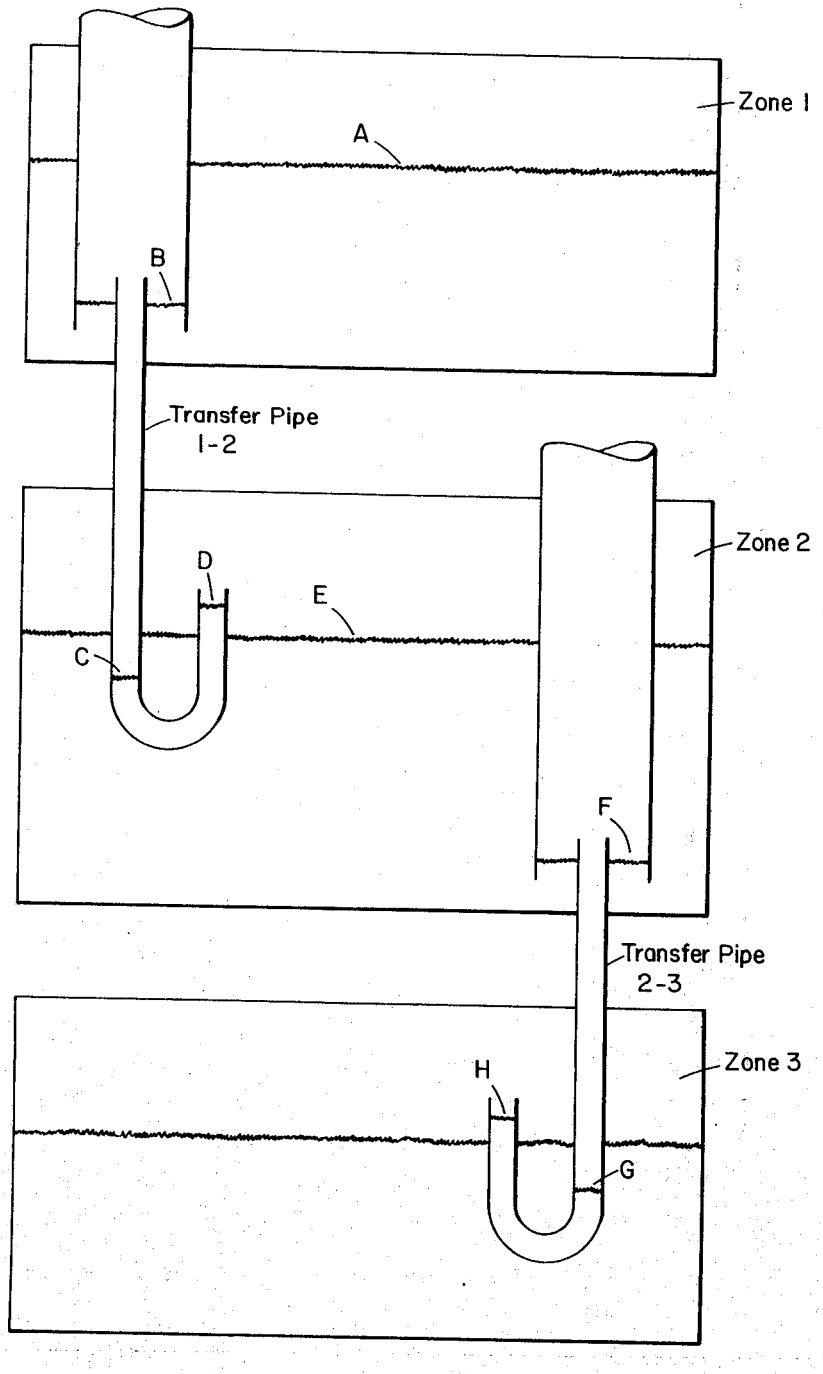
FIG. 4 is a schematic diagram to be used in conjunction with the accompanying calculation in the disclosure, of specific exemplary conditions for the control of flow of liquid steel from one zone to a next zone.

Presented schematically in FIG. 4 is a representation of the existing conditions in a series of three succeeding zones containing molten steel when there is no flow between zones. For the purpose of calculation steel is assumed to have a specific gravity of 7.00, which means that the steel would weigh 436 pounds per cubic foot. If in zone 1 the pressure on the liquid surface A is 14.2 psia and the vertical distance from surface A to the surface B in the annulus between the transfer pipe and the fluid pressure pipe is 10 feet, the pressure required on the surface B to prevent steel from entering transfer pipe 1-2 would be 6405 pounds per sq. ft., or 44.5 psia. This means that the gas pressure on liquid surface C in the trap in zone 2 would also be 44.5 psia.

Assuming zone 2 to be a degassing zone and that the pressure on liquid levels D and E is 1/10 of an atmosphere, i.e. 1.42 psia, the height between liquid levels C and D is calculated to be 14.2 feet.

With the pressure on surface E at 1.42 psia and the level of surface F 10 feet below surface E the pressure required on surface F to prevent liquid steel from entering transfer pipe 2-3 is calculated to be 4564 pounds per sq. ft., or 31.7 psia.

The gas pressure on surface G will be the same as on surface F, i.e. 31.7 psia. If the space above the liquid level in zone 3 is maintained at atmospheric pressure, that is 14.2 psia, the difference in height between surfaces G and H to keep liquid steel in the trap calculates to be 5.8 feet.

It is evident from the foregoing disclosures that the flow rates between the successive zones or chambers can be controlled by proper adjustment of gas pressures in the various chambers as well as in the various gas pressure pipes. It will be evident to those of skill in the art that flow rates between chambers will also be influenced by the number of transfer pipes used between zones or chambers, and by their diameters and by the placing of nozzles in the transfer pipes.

There are a number of advantages provided by the present invention that make it superior to previous processes for the handling of liquid metals such as molten steel. Valves, tilting means, and similar structures, machinery and devices heretofore needed for transferring or transporting the metal between conventional stages are eliminated. Moreover, because the invention involves a closed system the refractories are not exposed to thermal shock degradation.

I claim:

1. Apparatus for transferring metal in the molten state from a first zone to a second zone at a lower level by gravity flow which comprises a. a transfer pipe communicating between said zones with its open upper end terminating below the normal level of liquid within said first zone and with its lower end terminating in a dip leg trap within said second zone;

b. a gas pressure pipe having a larger inside diameter than the outer diameter of the transfer pipe said gas pressure pipe being positioned within said first zone so as to surround and extend below the upper inlet end of said transfer pipe; and c. means for introducing a gas under pressure into said gas pressure pipe, whereby exertion of gas pressure within the gas pressure pipe will cause the level of liquid in the annulus between the two pipes to be forced below the inlet of the transfer pipe.

2. Apparatus as defined in claim 1 wherein the cross sectional area of the annulus between the transfer pipe and the gas pressure pipe exceeds the cross sectional area within the transfer pipe.

3. Apparatus as defined by claim 1 wherein the transfer pipe has a portion adjacent its lower end that has a larger inside diameter than the remaining portions of the transfer pipe.

4. Apparatus as defined by claim 1 wherein the discharge outlet of the dip leg trap faces upwardly, is positioned above the normal liquid level within said second zone, and is provided with a splash plate whereby molten metal flowing from said outlet will have a large area thereof exposed to the atmosphere existing within said second zone before falling into the main body of molten metal in said second zone.

5. Apparatus as defined by claim 1 wherein one of said zones comprises a closed chamber having a roof and a wall extending from said roof downwardly to below the normal liquid level within said chamber thereby dividing the space above the liquid level into two separate gas pressure chambers, and including a slag discharge outlet having an upper inlet positioned above the normal liquid level in one of said separate gas pressure chambers whereby flow of liquid through said discharge outlet will not normally occur but can be caused to occur by increasing the gas pressure in the other of said gas pressure chambers.

6. Apparatus as defined by claim 1 including a second transfer pipe communicating between said second zone and a third zone, with the open upper end of said second transfer pipe terminating below the normal level of liquid within the second zone and with its lower end terminating in a dip leg trap within the third zone, a second gas pressure pipe positioned within said second zone in the same manner as described for said first gas pressure pipe within said first zone, and means for introducing a gas under pressure within said second gas pressure pipe.

7. Apparatus as defined by claim 6 including a fourth zone, a third transfer pipe communicating between said third and fourth zones, the open upper end of said third transfer pipe terminating below the normal level of liquid within said third zone and with its lower end terminating in a dip leg trap within the fourth zone, a third gas pressure pipe positioned within the third zone in the same manner as described for said first gas pressure pipe within said first zone, and means for introducing a gas under pressure within the third gas pressure pipe, whereby said four zones can be employed for the continuous manufacture of steel, said first zone serving as a primary alloy chamber or melt chamber, said second zone serving as a secondary alloy chamber, said third zone serving as a degas chamber, and said fourth zone serving as a casting chamber.

* * * * *